US005291758A

United States Patent [19]

Lee

[11] Patent Number: 5,291,758

[45] Date of Patent: Mar. 8, 1994

[54] FULLY AUTOMATIC CLOTHES WASHING MACHINE

[75] Inventor: Hyu C. Lee, Suweon, Rep. of Korea

[73] Assignee: Samsung Electronics Co., Ltd., Suwon, Rep. of Korea

[21] Appl. No.: 885,885

[22] Filed: May 20, 1992

[30] Foreign Application Priority Data

May 25, 1991 [KR] Rep. of Korea ..... 91-7510[U]

[51] Int. Cl.[5] ..... D06F 39/08

[52] U.S. Cl. ..... 68/196; 68/207; 68/208; 137/572

[58] Field of Search ..... 68/23.5, 196, 207, 17 R, 68/208; 137/571, 572

[56] References Cited

U.S. PATENT DOCUMENTS

| | | | |
|---|---|---|---|
| 2,223,998 | 12/1940 | Martin et al. | 68/23.5 |
| 2,296,264 | 9/1942 | Breckinridge | 68/207 X |
| 2,562,533 | 7/1951 | Dunlap | 68/207 X |
| 2,680,448 | 6/1954 | Strathearn et al. | 68/207 X |
| 3,127,067 | 3/1964 | Hall et al. | 68/17 R X |
| 3,176,484 | 4/1965 | Shelton | 68/196 |

FOREIGN PATENT DOCUMENTS

| | | | |
|---|---|---|---|
| 2639923 | 5/1977 | Fed. Rep. of Germany | 68/17 R |
| 0145937 | 1/1981 | German Democratic Rep. | 68/196 |
| 555280 | 1/1957 | Italy | 68/23.5 |
| 0020156 | 4/1988 | Japan | 68/207 |
| 1-78296 | 7/1989 | Japan | 68/17 R |
| 741674 | 12/1955 | United Kingdom | 68/23.5 |
| 901388 | 7/1962 | United Kingdom | 68/17 R |

*Primary Examiner*—Philip R. Coe

*Attorney, Agent, or Firm*—Burns, Doane, Swecker & Mathis

[57] ABSTRACT

A fully automatic clothes washing machine is provided with a heating apparatus arranged in a water container, on the upper portion of which an inner cover apparatus is installed to prevent the upward emanation of steam vapors therefrom. The water container includes a supporting member attached to the outer peripheral portion on the top portion of the water container to form an opening portion; and an inner cover apparatus attached at the edge to the supporting member and having means for forcing the other end to open or tightly close the opening portion.

8 Claims, 4 Drawing Sheets

FULLY AUTOMATIC CLOTHES WASHING MACHINE

BACKGROUND OF THE INVENTION

The present invention is related to providing a fully automatic clothes washing machine having a heating apparatus for washing clothing with hot or boiling water, and more particularly to providing a fully automatic clothes washing machine with an inner cover apparatus disposed on the upper portion of the washing container. The washing container is separated from a top cover, thereby maintaining the actual washing container in a sealed configuration in order to prevent the upward leakage of steam vapors during the wash water heating cycle.

PRIOR ART

A conventional fully automatic clothes washing machine is configured to provide a normal heating apparatus in a water container in order to clean the clothing with warm water, in which the water container includes a top cover mounted on an upper part of the container thus providing direct accessibility thereto. In the situation where the washing machine is used for washing clothing with boiling water, the machine operator would be exposed directly to the boiling water when the top cover is opened, thereby creating a risk of the operator getting burned by the boiling water.

This fully automatic clothes washing machine is available for washing clothes with warm water, not boiled water by means of a heating apparatus which heats the wash water that is fed from the outside to a predetermined temperature. However, it is not possible to perform a very high temperature cleaning process for laundering clothes because the installation of a safety apparatus for the user has not been considered. Consequently, the user can not expect to wash terribly contaminated clothes at the optimal cleaning level as one may desire.

Furthermore, the single top cover configuration allows for the greater leakage of steam vapors from the water container, resulting in a large amount of thermal losses, and the time required for heating the water is prolonged. Additionally, this particular seal for the steam vapors, which results in leakage of steam from the container, will cause damage to electrical parts of the washing machine.

On the other hand, Japan Utility Model Publication No. 85-80790 discloses a washing machine provided with a heating apparatus which is positioned in the water container. The washing machine includes a water container having a dual cover structure consisting of an inner cover and an outer cover, in which the outer portion of the inner cover is positioned inward on the opening of the water container, and its end edge extends downward. Therefore, the washing machine design is complex and troublesome to operate, and requires two lids for opening or closing of the water container. This renders the design inappropriate for use in a fully automatic clothes washing machine for washing clothing with hot or boiling water.

In order to resolve these problems, a main object of the present invention is to provide a fully automatic clothes washing machine which is capable of processing wash water of a very high temperature in addition to hot water washing.

Another object of the present invention is to provide a fully automatic clothes washing machine including an opening/closing apparatus that enables the water container in a fully automatic clothes washing machine to process clothes in boiled water.

Another object of the present invention is to provide a fully automatic clothes washing machine which uses only one inner cover closing apparatus for the water container, thereby to promoting the safety and convenience of the user which contributes to the product's reliability.

SUMMARY OF THE INVENTION

In order to accomplish these objects, the present invention relates to a fully automatic clothes washing machine which includes an inner cover apparatus installed in a water container which facilitates the heating of the wash water to a high temperature and also cleaning of the clothes. The water container comprises a supporting member attached to the outer peripheral portion of the top portion of the water container to form an opening thereon. Furthermore, an inner cover is attached to a first end of the supporting member and has means for forcing a second end of the inner cover to open or tightly close the opening. The inner cover apparatus is further comprised of a water-supply hole formed in its lower portion and a means for closing the water container, except during the water-supply cycle.

Thus, the present invention provides a prominent washing effect with the high temperature process of cleaning, and reduces thermal loss due to the tight seal of the inner cover on the water container during the hot or boiling waterwash cycle. Thus protecting the electrical components of the heater by preventing of leakage the steam vapor.

BRIEF DESCRIPTION OF THE DRAWINGS

The present invention will now be explained in detail with reference to the attached drawings, in which.

DETAILED DESCRIPTION OF THE PREFERRED EMBODIMENTS

Figure 1:
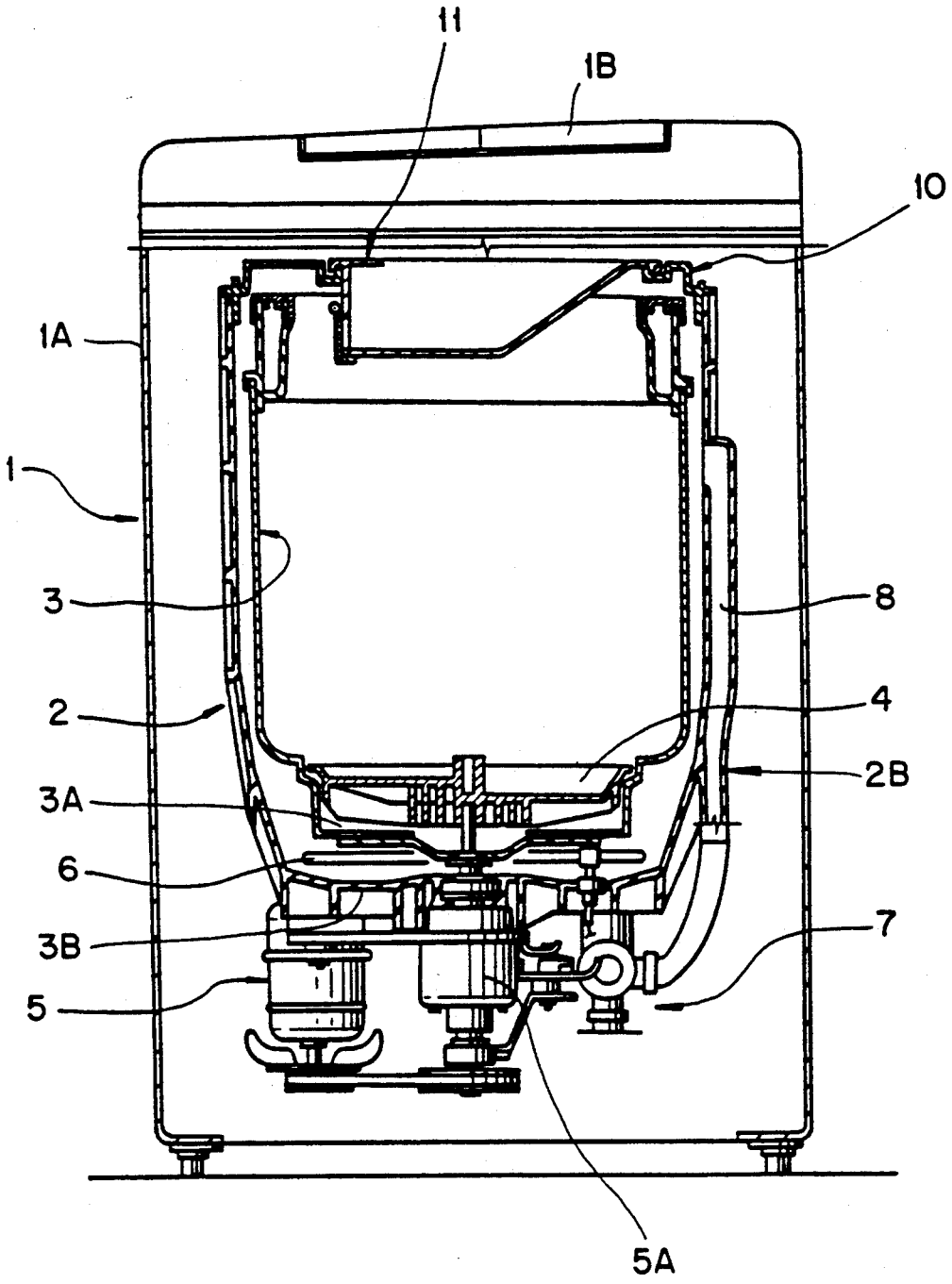
FIG. 1 is a vertical cross-sectional view showing a fully automatic clothes washing machine provided with an opening/closing apparatus for a water container according to the present invention.
Figure 2:
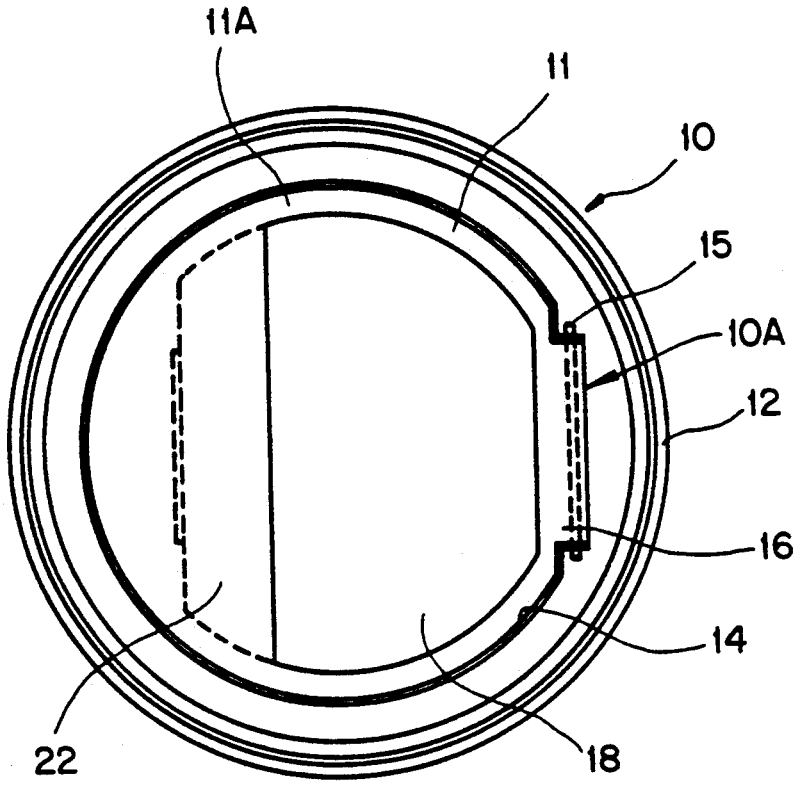
FIG. 2 is a plan view showing of an inner cover apparatus for the water container according to the present invention.
Figure 3:
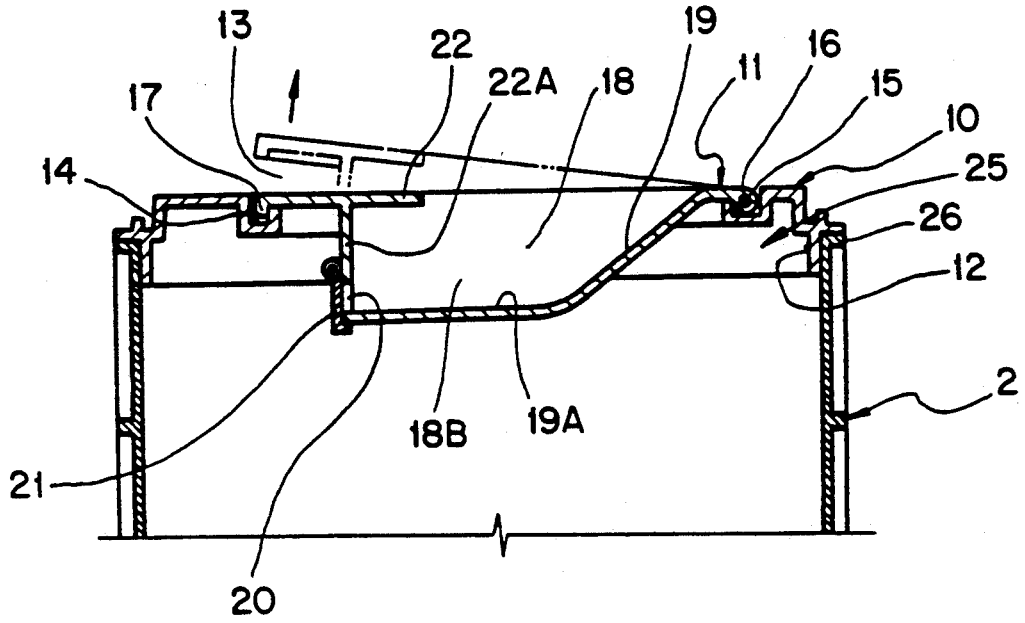
FIG. 3 is a cross-sectional view of the water container to which an inner cover is attached, according to the present invention.

FIG. 1 represents a fully automatic clothes washing machine according to the present invention, which includes a body 1. The body 1 includes a side wall 1A, and an openable cover 1B at an upper end thereof. The body 1 surrounds a water container 2 which retains washing water therein and a washing tank 3 which receives clothing. The water container 2 includes a washing tank 3, having an inner bottom 3A, an outer bottom 3B and a heating apparatus 6 mounted therebetween. The washing tank 3 has a pulsator 4 positioned therein, which is connected to a gear box 5A and is operated by the driving force of a motor 5. On a first side of the water container 2B is formed a washing water drainoutlet 7 which is connected to an overflow pipe 8.

The present invention relates to inner cover apparatus 11 for an automatic washing machine for opening and closing a top portion 25 of the water container 2, wherein the water container 2 includes a supporting member 10 attached to a top portion of the periphery 26 of the water container 2. The support member 10 is further attached to an inner cover apparatus 11 at a first end 10A to open and close the top portion of the water container 2.

The support member 10 is integrally attached to the outer periphery 26 along the top portion 25 of the water container 2 and includes: a coupling rim 12 fitted onto the top side of the water container 2, a perforated inner cover opening 13, for inserting and removing clothes to and from the washing tank 3, and a coupling groove 14 extending inward by a distance from an upper edge of the container 2 toward the perforated opening 13 at a predetermined distance, wherein the curved groove causes inner cover 11 to be tightly seated therein.

The inner cover apparatus 11 further includes: a hinged portion 16 which pivots about the support member 10 by means of a fixing pin 15, and a coupler 17 curving around the outer periphery of the inner cover 13, to be tightly inserted into the coupling groove 14. The inner cover apparatus 11 is provided with a water-supply guiding chamber 18, which slopes downward toward the inner portion 18B of the water container 2, to temporarily store wash water fed from a hose (not shown) mounted onto the washing machine which causes the water to flow into the washing tank 3.

The water-supply guiding chamber 18 includes a space therein with a tapered surface 19 for guiding the water-supply, a planar surface 19A extended from the tapered surface 19, and a shearing surface 22A vertically formed against the planar surface 19A.

The shearing surface 22A includes a water-supply hole 20 for feeding wash water into the water container 2, and a shutter 21 fixed at a second side of the water container 2. The shutter 21 opens and closes the water-supply hole 20, according to hydraulic pressure applied by means of the weight of the water. A handle portion 22 extends vertically toward the inner portion 18B of the water-supply guiding chamber 18 from a top end 27 of the shearing surface 22A at a predetermined distance, so that it blocks the upward splashing of wash water supplied from the hose, and facilitates the opening and closing of the washing tank 3.

The present invention is useful in a fully automatic washing machine provided with a microprocessor programmed to process clothing with not only warm or hot water but also boiling water.

As long as the present invention considers a top cover as a separate element, an opening/closing apparatus 11 is opened on a pivot at the hinged portion 16 with a handle portion 22 being moved upward, so that clothing is inserted or removed in a normal manner through the clothes inserting/removing opening 13.

As the inner cover 11 is closed, a coupler 17 is tightly inserted into a coupling groove 14, formed in the supporting member 10. In addition, the shutter 21 closes a water-supply hole 20, thereby completely sealing the water container 2.

Figure 4A:
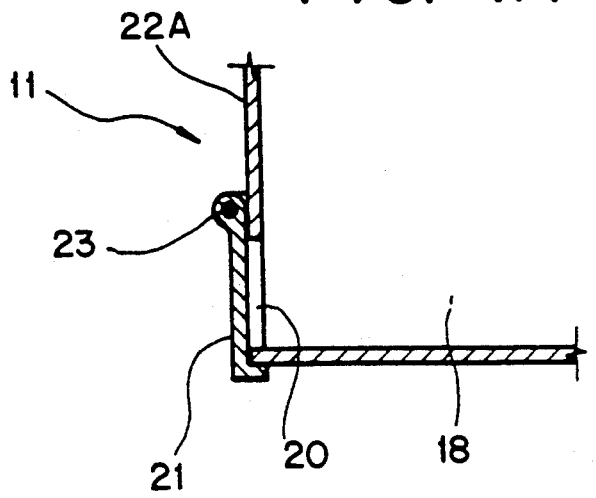
FIG. 4A is a cross-sectional view of the shutter of the inner cover in a closed position, according to the present invention.
Figure 4B:
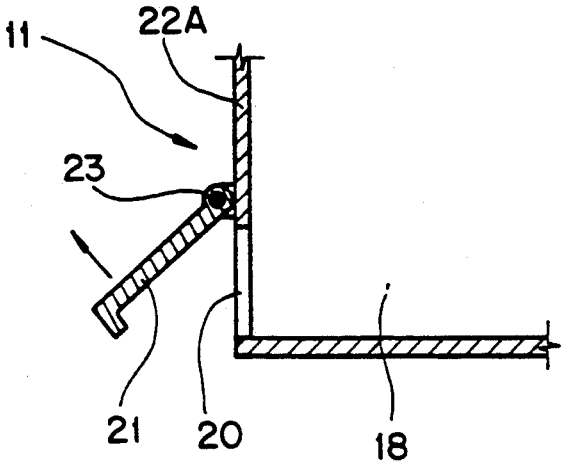
FIG. 4B is a cross-sectional view of the shutter of the inner cover in an open position according to the present invention.

For the purpose of cleaning the clothing, the sealed water-supply causes the wash water to be temporarily stored in a water-supply guiding chamber 18. From the weight of the stored water, the shutter 21 is then forced to open the water-supply hole 20, thereby allowing wash water to flow into the water container 2 as shown in FIG. 4B. After completing the water-supply cycle, the shutter 21 seals the water-supply hole 20 as shown in FIG. 4A.

Figure 5:
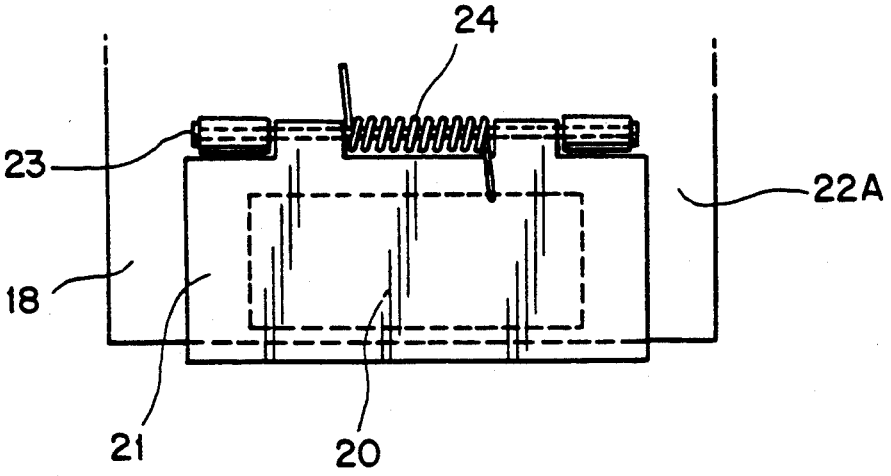
FIG. 5 is a front view of another embodiment of the shutter according to the present invention.

On the other hand, as shown in FIG. 5, a shutter 21 is provided with a coil spring 24 which is elastically supported at both ends of the shutter 21, as shown in FIG. 5. The shutter is supported at a first end 28 by a vertical shearing surface 22A, by a hinge shaft 23 at a second end 29. This sealing means enables the user to wash clothing with hot or boiling water.

In addition, the automatic washing machine can be pre-programmed by incorporating the use of a temperature sensor (not shown). A power source is applied to the heating apparatus 6, thereby heating the wash water. The heating apparatus further controls the heat supplied to the water by enabling the temperature sensor, thus allowing the operator to wash clothing at a predetermined temperature.

During the heating of the wash water, a large amount of steam vapor is generated in the wash water. The steam vapors rises in the water container 2 and is then discharged a out of a water drain outlet 7 from the overflow pipe 8. Whereby, the sealing of the water container 2 blocks the leakage of the steam vapor.

Thus, the present invention protects electrical equipment from damage caused by steam vapors and reduces the associated thermal loss, thereby promoting the optimal performance of the washing machine. Furthermore, it is noted that the installation of an inner cover apparatus allows for clothing to be washed at temperatures higher than that of a conventional washing machine which uses hot water, thereby increasing the washing efficiency of the washing machine.

What is claimed is:

1. A washing machine comprising:

an upwardly open washing tank having a first side wall;

a water container having a second side wall surrounding said first side wall and including an overflow pipe, an upper end of said second side wall forming an upwardly open opening;

a support member fixed to said upper end and extending around said opening, said support member forming an upwardly open annular groove spaced inwardly of said upper end of said second side wall; and a cover for closing said opening, said cover including an outer peripheral edge hingedly connected by a hinge to said support member to be swingable between open and closed position, said peripheral edge including an downward projection disposed along all of said peripheral edge except for said hinge, said projection being received in said groove when said cover is in said closed position; said cover including a lifting handle situated at a location disposed opposite said hinge, said cover forming a water-guiding chamber for guiding wash water into said tank, said chamber including an upright surface disposed adjacent said handle, and an inclined surface inclined downwardly toward said upright surface from a location adjacent said hinge, said upright surface including a water supply hole extending therethrough at a lower end thereof to conduct wash water into said tank, and a shutter mounted on said cover for movement between first and second positions for opening and closing, respectively, said water supply hole, said shutter being generally upright when in said second position.

2. A washing machine according to claim 1, wherein said shutter is hinged for swinging movement between said first and second positions.

3. A washing machine according to claim 2, wherein said shutter is hinged along its upper edge whereby said shutter is biased to said second position and can be swung to said first position by the weight of wash water in said chamber.

4. A washing machine according to claim 3, wherein said shutter is biased by its own weight to said second position.

5. A washing machine according to claim 3 including a spring for biasing said shutter to said second position.

6. A washing machine comprising:

an upwardly open washing tank having a first side wall;

a water container having a second side wall extending around said first side wall and including an overflow pipe, an upper end of said second side wall forming an upwardly open opening;

a support member fixed to said upper end and extending around said opening, said support member forming an upwardly open annular groove spaced inwardly of said upper end of said second side wall; and a cover for closing said opening, said cover being connected by a hinge to said support member to be swingable between open and closed positions, and including a water supply hole extending therethrough for conducting wash water, and a shutter mounted on said cover for movement between first and second positions for opening and closing, respectively, said water supply hole, said shutter being generally upright when in said second position.

7. A washing machine according to claim 6, wherein said shutter is hingedly connected to said cover by a hinge.

8. A washing machine according to claim 7, wherein said hinge which connects said shutter to said cover forms a horizontal pivot axis situated along a top edge of said shutter.

* * * * *